US010654146B2

(12) United States Patent
Baurceanu et al.

(10) Patent No.: US 10,654,146 B2
(45) Date of Patent: May 19, 2020

(54) ONE OR MORE CHARGING MEMBERS USED IN THE MANUFACTURE OF A LAPPING PLATE, AND RELATED APPARATUSES AND METHODS OF MAKING

(71) Applicant: Seagate Technology LLC, Cupertino, CA (US)

(72) Inventors: Mihaela Ruxandra Baurceanu, Edina, MN (US); Ricky Ray Anderson, Bloomington, MN (US); Andrew David Habermas, Bloomington, MN (US); Chea Phann, Woodbuy, MN (US)

(73) Assignee: Seagate Technology LLC, Fremont, CA (US)

( * ) Notice: Subject to any disclaimer, the term of this patent is extended or adjusted under 35 U.S.C. 154(b) by 201 days.

(21) Appl. No.: 15/877,615

(22) Filed: Jan. 23, 2018

(65) Prior Publication Data

US 2019/0224806 A1 Jul. 25, 2019

(51) Int. Cl.

| | |
|---|---|
| ***B24B 37/04*** | (2012.01) |
| ***B24B 49/00*** | (2012.01) |
| ***B24B 37/14*** | (2012.01) |
| ***B24B 37/16*** | (2012.01) |
| ***B24B 53/017*** | (2012.01) |
| ***B24B 57/02*** | (2006.01) |
| ***B24B 37/02*** | (2012.01) |
| ***B24B 37/10*** | (2012.01) |

(52) U.S. Cl.

CPC ..... *B24B 37/046* (2013.01); *B24B 37/022* (2013.01); *B24B 37/10* (2013.01); *B24B 37/14* (2013.01); *B24B 37/16* (2013.01); *B24B 49/006* (2013.01); *B24B 53/017* (2013.01); *B24B 57/02* (2013.01)

(58) Field of Classification Search

CPC ..... B24B 37/046; B24B 37/022; B24B 37/14; B24B 49/006; B24B 53/017; B24B 57/02

See application file for complete search history.

(56) References Cited

U.S. PATENT DOCUMENTS

| | | | | |
|---|---|---|---|---|
| 5,582,540 | A * | 12/1996 | Su | B24B 37/16 451/259 |
| 6,585,559 | B1 * | 7/2003 | Griffin | B24B 37/04 451/28 |
| 6,602,108 | B2 | 8/2003 | Griffin et al. | |
| 6,953,385 | B2 | 10/2005 | Singh, Jr. | |
| 7,169,031 | B1 * | 1/2007 | Fletcher | B24B 37/245 451/528 |
| 7,255,633 | B2 | 8/2007 | Muldowney | |
| 7,261,621 | B2 | 8/2007 | Moon et al. | |

(Continued)

FOREIGN PATENT DOCUMENTS

JP 09102475 A 4/1997

OTHER PUBLICATIONS

Baurceanu et al., U.S. Appl. No. 15/693,837, filed Sep. 1, 2017.

*Primary Examiner* — Dung Van Nguyen

(74) *Attorney, Agent, or Firm* — Kagan Binder, PLLC

(57) ABSTRACT

The present disclosure includes charging members for charging abrasive particles into the surface of a lapping plate. The charging members include one or more channels to permit abrasive slurry to flow through when the charging member is in contact with the lapping plate.

19 Claims, 11 Drawing Sheets

(56) References Cited

U.S. PATENT DOCUMENTS

| | | | | |
|---|---|---|---|---|
| 2002/0155791 | A1* | 10/2002 | Nguyen | B24B 37/042 451/36 |
| 2002/0173233 | A1* | 11/2002 | Griffin | B24B 37/04 451/8 |
| 2005/0176351 | A1* | 8/2005 | Singh, Jr. | B24B 37/00 451/28 |
| 2009/0258575 | A1 | 10/2009 | Hreha et al. | |
| 2015/0000202 | A1 | 1/2015 | Moudry et al. | |
| 2018/0001439 | A1 | 1/2018 | Phann et al. | |

* cited by examiner

ONE OR MORE CHARGING MEMBERS USED IN THE MANUFACTURE OF A LAPPING PLATE, AND RELATED APPARATUSES AND METHODS OF MAKING

BACKGROUND

The present disclosure relates to charging members that can be used for embedding abrasive particles into a lapping plate and related methods.

SUMMARY

Embodiments of the present disclosure include an apparatus for processing a major surface of a lapping plate platen during the manufacture of an abrasive surface on the major surface of the lapping plate platen, wherein the apparatus includes:

a) a rotatable platter configured to secure and physically support the lapping plate platen during processing of the major surface of the lapping plate platen;

b) at least one processing head mechanism that is rotatably and removably coupled to a processing head, wherein the processing head includes:

i) a base;

ii) at least one charging member coupled to the base, wherein the at least one charging member has at least one channel opening that defines at least two land areas, wherein the processing head mechanism is configured to move the processing head in at least the z-axis direction to contact the major surface of the lapping plate platen with the at least two land areas under pressure to charge abrasive particles into the surface of the lapping plate platen, wherein the processing head mechanism is configured to rotate the processing head about its central axis in the z-axis direction while the at least two land areas of the at least one charging member are in contact with the major surface of the lapping plate platen under pressure to charge abrasive particles into the surface of the lapping plate platen, wherein the at least one channel opening is located proximal to an outer perimeter of the charging member, wherein the at least one channel opening permits abrasive slurry to flow through the channel opening from a position outside the charging member outer perimeter to a position inside the charging member outer perimeter when the at least two land areas are in contact with the major surface of the lapping plate platen.

DETAILED DESCRIPTION

Lapping machines (apparatuses) can be used to perform lapping operations on various substrates such as a bar of sliders, which can ultimately be used to perform read/write operations in a hard disk drive using a transducer ("head"). Such lapping machines can use a lapping plate that performs grinding and/or polishing operations on a substrate such as a bar of sliders. Lapping machines can include a rotating lapping plate that defines a lapping surface which can help abrade the surface of a ceramic material such as AlTiC, which is a two phase composite of alumina ($Al_2O_3$) and titanium-carbide (TiC). If desired, a slurry can be applied to the lapping surface to enhance the abrading action as the lapping surface is rotated relative to a slider bar containing a plurality of the sliders held in a pressing engagement against the lapping surface. A lapping plate can be used for a variety of lapping processes such as rough lapping, fine lapping, and kiss lapping.

Embodiments of the present disclosure include an apparatus for processing a major surface of a lapping plate platen during the manufacture of an abrasive surface on the major surface of the lapping plate platen. The apparatus can include a rotatable platter and a processing head mechanism. The rotatable platter can be configured to secure and physically support a lapping plate platen during processing of the major surface of the lapping plate platen. The processing head mechanism can be rotatably and removably coupled to a processing head. The processing head can include a base and at least one charging member coupled to the base.

A variety of exemplary apparatuses can be used for processing a lapping plate platen so as to form a lapping plate. An example of such an apparatus is described in U.S. Pat. No. 6,585,559 (Griffin et al.), wherein the entirety of said patent is incorporated herein by reference. Either a multi-step apparatus can be used or a single-step apparatus can be used. Apparatuses and methods for charging abrasive particles into lapping plate platens are also reported in U.S. Ser. No. 15/198,566 (Phann et al.) and U.S. Ser. No. 15/693, 837 (Baurceanu et al.), wherein the entireties of said patent documents are incorporated herein by reference.

A "multi-step" apparatus, machine, or tool can be configured to perform multiple processes on a platen so as to form a lapping plate. An example of a multi-step apparatus 100 for processing a major surface of a lapping plate platen during the manufacture of an abrasive surface on the major surface of the lapping plate platen is described below with respect to FIGS. 1, 2, 3, and 4.

Figure 1:
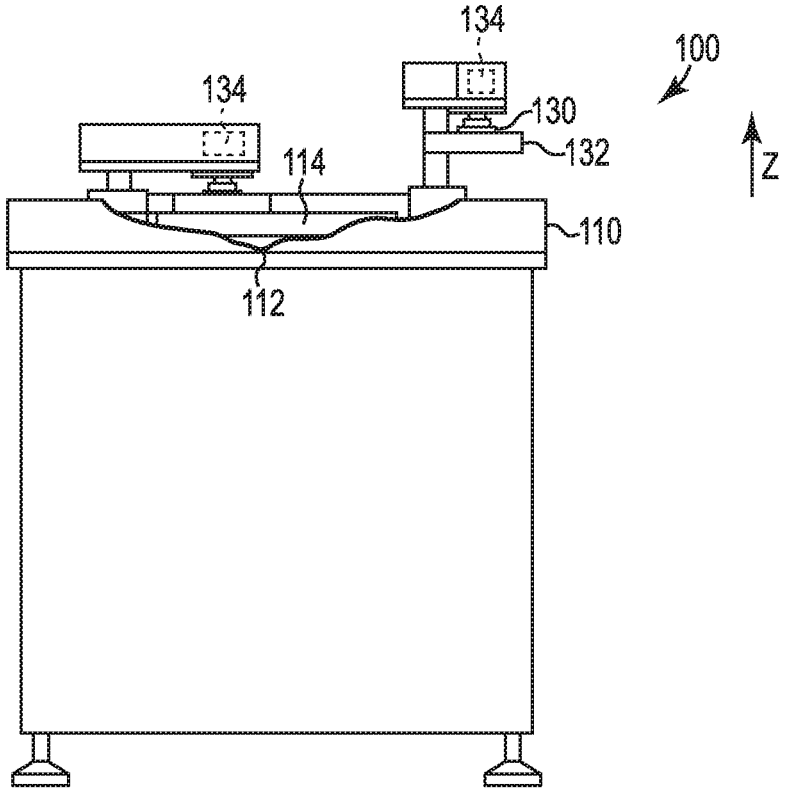
FIG. 1 is a schematic elevation view showing a multi-step apparatus for processing a major surface of a lapping plate platen.

As shown, apparatus 100 includes a base 110. The base 110 can be constructed of rigid or high strength materials. As illustrated in FIG. 1, the base 110 can be mounted on stands, or appropriate support members. As shown, a rotatable platter 112 is rotatably mounted on the base 110. The rotatable platter 112 (or turn table) is configured to secure and physically support the lapping plate platen 114 during processing of the major surface 116 of the lapping plate platen 114 so that it can function as a lapping plate and perform lapping operations. In more detail, the platen 114 includes one or more surfaces 116 (only one shown) that can be used to perform the actual lapping operations. At least the surface 116 of the platen 114 (e.g., the whole platen) can be an alloy made out of one or more metals. Exemplary metals include at least one of tin, tin alloy (e.g., tin/antimony), aluminum, copper, combinations of these, and the like.

Platen 114 can have a wide variety of diameters. In some embodiments, platen 114 can have a diameter in the range from 10 to 20 inches.

A main drive motor (not shown) can be attached to the base 110, and can provide the force to rotate the platter 112 during operation of the apparatus 100 (e.g., counterclockwise as indicated by arrow 143). Also, a spindle assembly (not shown) can be coupled to the main drive motor in order to rotate the platter 112.

An apparatus according to the present disclosure can include one or more liquid dispensers configured to dispense one or more liquid treatment compositions onto the major surface 116 of the lapping plate platen 114. As shown, apparatus 100 includes a dispensing unit 138 mounted on the base 110. The dispensing unit 138 can be configured to dispense controlled quantities of a liquid treatment composition onto the surface 116 of the platen 114. The liquid treatment composition dispensed on the platen 114 can be for example in the form of a liquid containing predetermined concentrations of abrasive particles ("abrasive slurry"). The dispensing unit 138 can be configured to dispense a liquid treatment composition in various manners depending on the specific operation being performed. For example, the dispensing unit 138 can be configured to dispense a liquid treatment composition in a drip fashion onto the surface 116. The dispensing unit 138 can be further controlled to either dispense or not dispense a liquid treatment composition for predetermined intervals of time depending on the specific protocol of the operation being performed.

Figure 2:
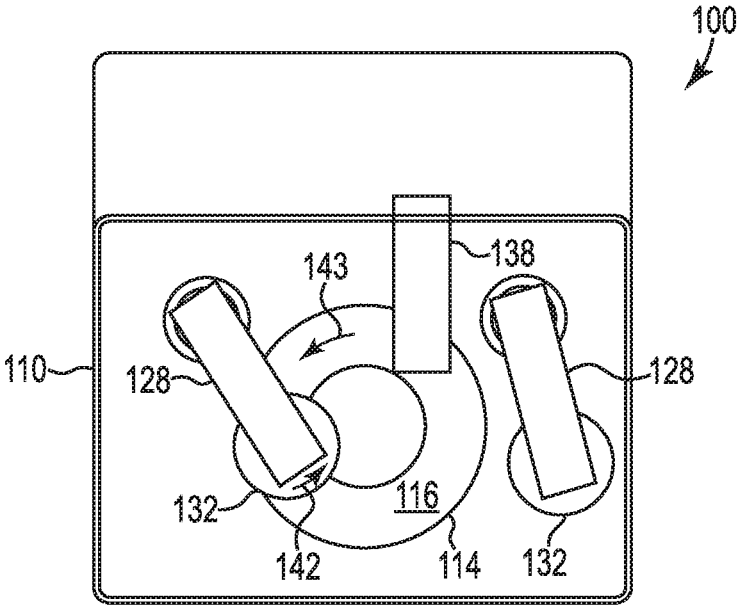
FIG. 2 is a plan view of the apparatus shown in FIG. 1.

As shown, the apparatus 100 includes a pair of arms 128 disposed on the base 110. Although only two arms 128 are illustrated in FIGS. 1 and 2, it should be appreciated that various other configurations are possible. For example, only one arm 128 may be provided, or more than two arms 128 can be provided. As shown, each arm 128 includes a processing head mechanism 130 that can receive the processing head 132 and is rotatably and removably coupled to a processing head 132 so that processing head 132 can gimble. Each processing head 132 is attached to each processing head mechanism 130 for performing operations on the surface 116 of the platen 114. Each processing head mechanism 130 is rotatably mounted to its respective arm 128 so that processing head 132 is capable of rotation. As shown, each arm 128 further includes a spindle motor 134 that controls rotation of the processing head mechanism 130. In some embodiments, the processing head mechanism 130 can be configured with a quick change arrangement that can readily accept a variety of texturizing, shaving, washing, charging, and other processing heads 132. The arms 128 are used (in conjunction with the heads 132) to process (e.g., texturizing, washing, shaving, and charging operations) the platen 114 in preparation for lapping operations.

Figure 4:
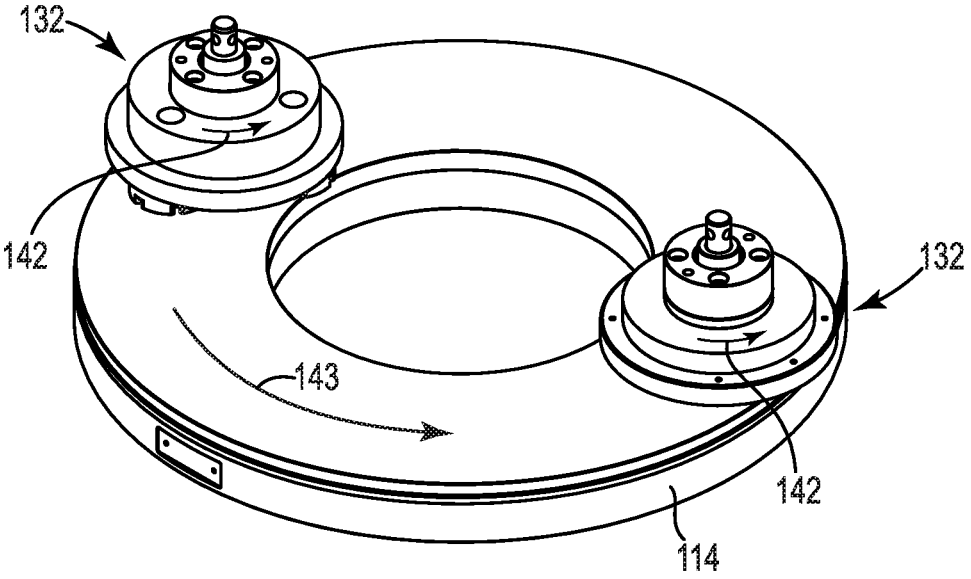
FIG. 4 is a partial, perspective view of the apparatus shown in FIG. 1 showing both processing heads overlying the lapping plate platen.

An actuator (not shown) can be coupled to each arm 128. The actuators can function to place the processing heads 132 in desired alignment with the surface 116 of the platen 114. Accordingly, the actuators are capable of placing the arms 128 in various operating positions. For example, the apparatus 100 can be configured to move the processing head 132 in at least the z-axis direction to contact the major surface 116 of the lapping plate platen 114 with the at least one processing member (not shown) under pressure to modify the surface 116 of the lapping plate platen 114 during the manufacture of the abrasive surface on the major surface of the lapping plate platen 114. As shown in FIG. 2, the processing head mechanism 130 can be placed in a first position wherein at least a portion of the processing head 132 overlies a portion of the surface 116 of the platen 114 when at least a portion of the processing head 132 is in contact with the surface 116. A second position is also shown wherein another processing head 132 has been raised and placed out of alignment with the platen 114 (the processing head 132 is completely outside the perimeter of surface 116). It can be appreciated that the actuators can also be capable of placing the processing heads 132 in any intermediate positions between the two positions illustrated in FIG. 2. Also, FIG. 4 illustrates a partial view of apparatus 100 where both processing heads 132 overlie at least a portion of the surface 116 of the platen 114 so that processing members on each processing head 132 can rotate as indicated by arrows 142 and contact surface 116. By virtue of its mode of operation, the actuators can be controllable for placing processing members that are attached to the heads 132 in contact with the surface 116 of the platen 114. In some embodiments, one or more predetermined weights (not shown) can be coupled with each arm 128 and head 132 so that a predetermined amount of pressure is applied downward on the head 132 and, therefore, the surface 116 of platen 114 during processing. Alternatively, pneumatic pressure can be used to apply downward pressure on head 132.

A "single-step" apparatus can be configured to perform only a single process on the surface of a platen so as to form a lapping plate. For example, such an apparatus may be substantially similar to apparatus 100 with the exception of having only one arm 128 and one processing head 132.

A processing head 132 can be configured based on a given processing step. In some embodiments, a processing head includes a base and at least one processing member coupled to the base.

One or more processing members can be selected based on the desired processing operation to be performed on a lapping plate platen. For example, a processing member can contact the major surface of the lapping plate platen under pressure to modify the surface of the lapping plate platen during the manufacture of the abrasive surface on the major surface of the lapping plate platen. Nonlimiting examples of processing members include one or more blades for shaving, one or more (e.g., 3 to 8, or even 3 to 6) charging members (e.g., bars and/or rings) for charging abrasive particles into the lapping plate platen, combinations of these, and the like.

The present disclosure includes charging members having a topography that can facilitate recirculating abrasive slurry from outside the outer perimeter of a charging member inward, especially from the outer perimeter of the underlying lapping plate platen toward a relatively inward position on lapping plate platen. Advantageously, relatively less abrasive slurry can go unused during a charging protocol, thereby resulting in a relatively lower amount of charging slurry dispensed. Lowering the amount of charging slurry dispensed during a charging protocol can result in significant cost savings. Also, charging members according to the present disclosure can improve the distribution of charging slurry at the interface between a given charging element and the lapping plate platen during the charging process, thereby increasing the density of abrasive particles that are charged into the underlying lapping plate platen. Increasing the density of abrasive particles can facilitate lapping more row bars with a given lapping plate platen, resulting in less down time for changing lapping plate platens and increased capacity for a given lapping plate platen.

A charging member according to the present disclosure has at least one channel opening that defines at least two land areas. A processing head mechanism can be configured to move the processing head in at least the z-axis direction during charging to contact the major surface of the lapping plate platen with the land areas under pressure to charge abrasive particles into the surface of the lapping plate platen. Also, the processing head mechanism can be configured to rotate the processing head about its central axis in the z-axis direction while the land areas of a charging member are in contact with the major surface of the lapping plate platen under pressure to charge abrasive particles into the surface of the lapping plate platen. According to the present disclosure, at least one channel opening can be located proximal to an outer perimeter of a charging member to permit abrasive slurry to flow through the channel opening during charging from a position outside the charging member outer perimeter to a position inside the charging member outer perimeter.

Nonlimiting examples of charging members having one or more channels according to the present disclosure are described in detail herein below.

One embodiment is illustrated in FIGS. 5A, 5B, 5C, and 5D. As shown, three charging members in the form of charging rings 550 are mounted onto processing head 532. Processing head 532 is identical to processing head 132, with the exception of charging rings 550 described herein. Charging rings 550 can be used to force (embed) abrasive particles into the major surface of the lapping plate platen while the land areas of the charging ring are in contact with the major surface of the lapping plate platen. Embedding abrasive particles into a lapping plate to form an abrasive surface is a process that can be referred to as "charging."

As shown, processing head 532 includes three charging members 550 attached to the head 532. The charging members 550 can be coupled to the head 532 by any suitable fastening technique (e.g., threaded bolts, adhesive, combinations of these, and the like). Also, charging members can be rigidly and/or resiliently coupled to a processing head.

The number of channel openings and channels in a given charging member can be selected as desired. In some embodiments, the number of channel openings in a charging member can be from 1 to 10, from 1 to 10, or even from 3 to 8. As shown, each charging member 550 has five channel openings 555. Each channel opening 555 and corresponding channel 556 (also called groove) defines two land areas 552 on each side of the channel 556. A processing head mechanism such as 130 can be configured to move the processing head 532 in at least the z-axis direction to contact the major surface 116 of the lapping plate platen 114 with the land areas under pressure to charge abrasive particles into the surface 116 of the lapping plate platen 114. The processing head mechanism 130 can also be configured to rotate the processing head 532 about its central axis 553 in the z-axis direction while the land areas 552 of each charging member 550 are in contact with the major surface 116 of the lapping plate platen 114 under pressure to charge abrasive particles into the surface 116 of the lapping plate platen 114. As shown, each channel opening 555 is located proximal to an outer perimeter 554 of the charging ring 550 so that each channel opening 555 can permit abrasive slurry to flow through the channel opening 555 from a position outside the charging member outer perimeter 554 to a position inside the charging member outer perimeter 554, as indicated by arrow 557, when the land areas 552 are in contact with the major surface 116 of the lapping plate platen 114. As the slurry contacts a channel sidewall while the charging ring 550 rotates around center 553 as processing head 532 rotates, the slurry tends to flow toward the center 533 of the charging ring 550.

Each charging ring 550 can be made out of a wide variety of materials for charging abrasive particles into a lapping plate platen. In some embodiments, a charging ring 550 can be made out of one or more metals, one or more ceramics, one or more polymers, one or more glasses, and combinations thereof. In some embodiments, a charging ring 550 can be made out of ceramic material such as alumina, zirconia toughened alumina (ZTA), yttria stabilized zirconia, boron nitride, aluminum nitride, aluminum silicate, magnesium oxide, combinations of these, and the like.

While three charging rings 550 are shown mounted to processing head 532, any number of charging rings 550 can be used as desired. For example, one or more, three or more, or even six or more charging rings 550 could be included in a single processing head 532.

While circular shaped charging rings 550 are shown, any desired shape can be used. Examples of other shapes include elliptical shapes, polygonal shapes, and the like.

The diameter 558 of each charging ring 550 can be selected as desired. In some embodiments, a charging ring can have a diameter 558 in the range from 0.5 to 4 inches, or from 1 to 3 inches.

The thickness 559 of each charging ring 550 can be selected as desired. In some embodiments, a charging ring 550 can have a thickness 559 in the range from 1/16 to 4 inches, or from 1/8 to 2 inches.

A variety of channel shapes and types can be used. As shown, channels 556 are radial and arc-shaped along the length of the channel. Each channel 556 includes two sidewalls 560 and 561 that extend from the outer perimeter 554 of the charging ring 550 toward the center 533 of the charging ring 550. Each of the sidewalls 560 and 561 of each channel 556 are arc-shaped along the length of the channel. Each the sidewalls 560 and 561 are curved in the same direction that processing head mechanism is configured to rotate as shown by arrow 542. In some embodiments, the radius of curvature of sidewalls 560 and 561 can be in the range from 0.1 to 2 inches, or even from 0.2 to 1.5 inches. A wide variety of channel depths can be used. The depth of the channel can be selected so as to facilitate the flow of abrasive slurry through the channel opening from a position outside the charging member outer perimeter to a position inside the charging member outer perimeter when the land areas are in contact with the major surface of the lapping plate platen. The channel depth may be uniform or vary along the length of a channel. In some embodiments, the channel depth corresponds to the distance of the channel vertical sidewalls from top to bottom. For example, the channel depth 563 of channels 556 corresponds to the distances of the vertical sidewalls 560 and 561 from top to bottom. In some embodiments, the channel depth can be in the range from 1/16 inch to 3 inches, from 1/16 to 2 inches, or even from 1/8 inch to 1.5 inches. In some embodiments, the channel sidewalls can sloped or rounded from top to bottom.

A wide variety of channel widths can be used. The width of the channel can be selected so as to facilitate the flow of abrasive slurry through the channel opening from a position outside the charging member outer perimeter to a position inside the charging member outer perimeter when the land areas are in contact with the major surface of the lapping plate platen. The channel width may be uniform or vary along the length of a channel. In some embodiments, the channel width 565 can be in the range from 1/16 inch to 1 inch, from 1/16 to 3/4 inches, or even from 1/8 inch to 1/2 inches.

Figure 5A:
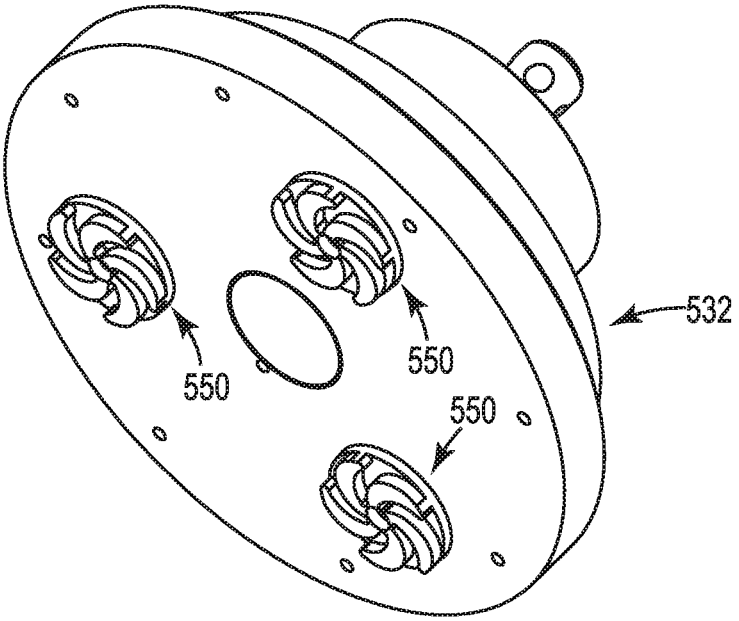
FIG. 5A perspective view of an embodiment of a processing head that includes three charging rings.
Figure 5B:
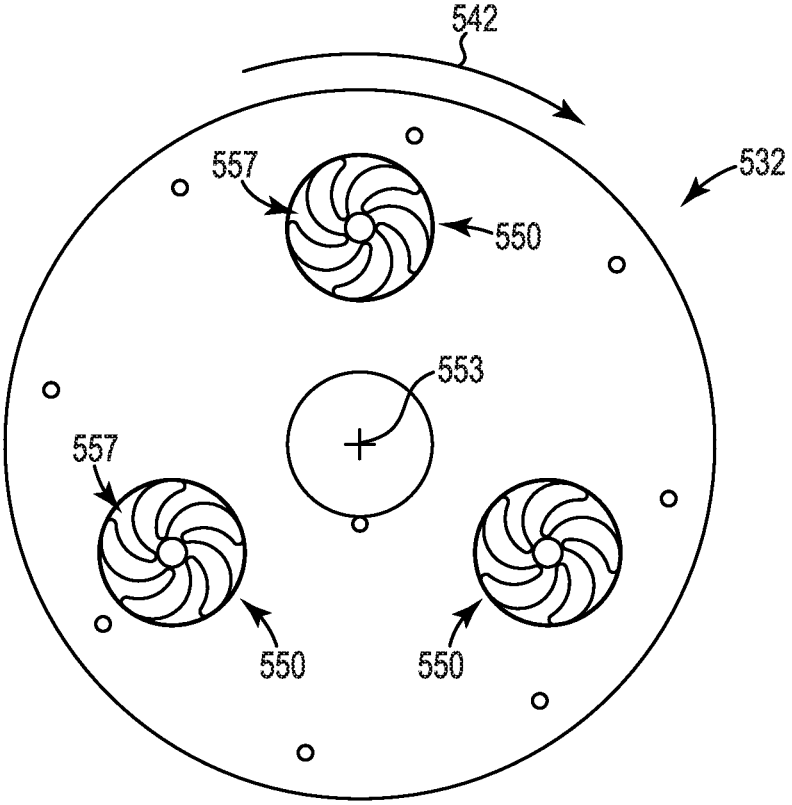
FIG. 5B is a bottom view of the processing head shown in FIG. 5A.
Figure 5C:
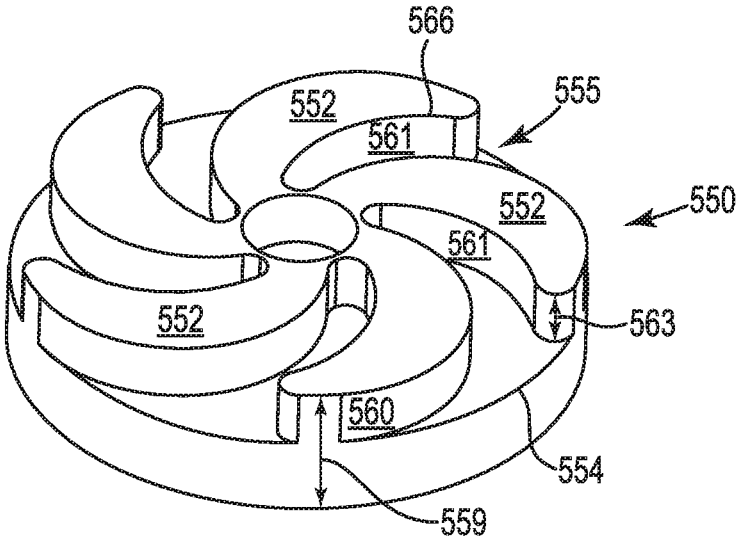
FIG. 5C is a perspective bottom view of a charging ring shown in FIG. 5A.
Figure 5D:
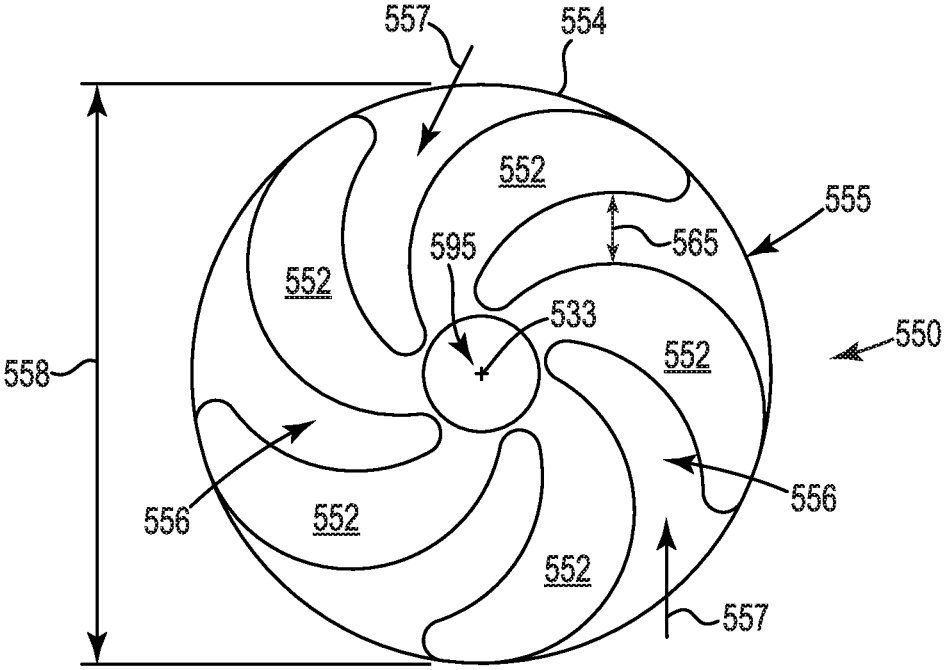
FIG. 5D is a bottom view of a charging ring shown in FIG. 5A.

A variety of transitions between a land area and a channel sidewall can be used. A transition between a land area and a channel sidewall can be selected so as to facilitate the charging of abrasive particles by the land area into the underlying lapping plate platen while at the same time permitting the flow of abrasive slurry through the channel opening from a position outside the charging member outer perimeter to a position inside the charging member outer perimeter when the land areas are in contact with the major surface of the lapping plate platen. Non-limiting examples of a transition between a land area and a channel sidewall include an angled transition (e.g., right-angle, obtuse angle, or acute angle), a rounded transition, a chamfered transition, combinations of these, and the like. As shown in FIG. 5C, the transition 566 between the sidewall 561 and land area 552 is a right angle.

Charging ring 550 can include a mounting hole 595 for mounting charging ring 550 to process head 532. Hole 595 defines an inner radius 596.

Figure 3:
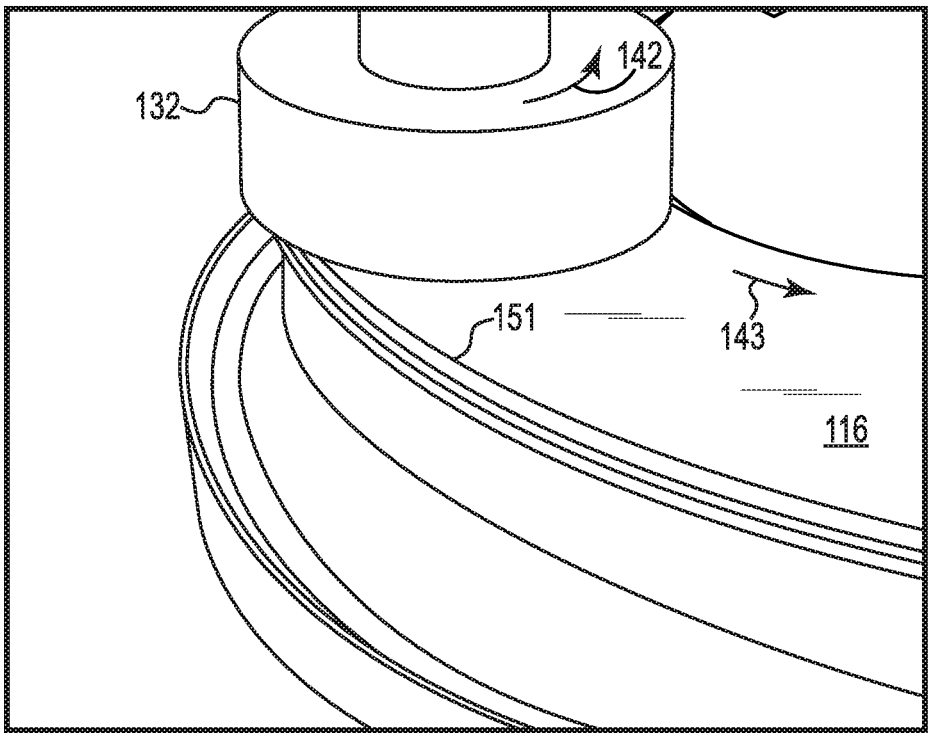
FIG. 3 is a partial, perspective view of the apparatus shown in FIG. 1.

An example of "charging" the surface 116 with a slurry of abrasive (e.g., diamond) particles to form a charged lapping surface is described herein below in connection with apparatus 100, where processing head 532 is an example of a charging processing head 132 shown in FIGS. 1-3. "Charging" refers to a process of embedding abrasive particles from a suspension in a liquid into the surface 116 of platen 114.

Abrasive particles can be made out of one or more materials. In some embodiments, abrasive particles are selected from the group consisting of diamond particles, cubic boron nitride particles, alumina particles, alumina zirconia particles, silicon carbide particles, and combinations thereof. In some embodiments, abrasive particles can have an average particle diameter of 200 nanometers or less, 100 nanometers or less, 75 nanometers or less (e.g., from 5 to 70 nanometers), 60 nanometers or less, or even 50 nanometers or less. In some embodiments, the surface of the lapping plate platen after charging has an average surface roughness of 100 nanometers or less, 50 nanometers or less, 15 nanometers or less, or even 10 nanometers or less.

Charging can be performed using a processing head 132 (532) in combination with an abrasive charging slurry dispensed from dispensing unit 138. Specifically, as discussed above, pneumatics or predetermined weights (not shown) can be coupled with each arm 128 and head 132 (532) so that a predetermined amount of pressure is applied to the land areas 552, and from the land areas 552 to the surface 116 of platen 114 to help embed the abrasive particles contained in the slurry into the lapping surface 116. In addition to rotating platter 112 and platen 114 as indicated by arrow 143, a processing head 132 (532) can be rotated as indicated by arrow 142 (542) around the center (553) of processing head (532) for a period of time to embed a desired amount of abrasive particles into the surface 116. It is noted that rotating platter 112 and head 132 (532) are not restricted to a particular direction of rotation as long as any curved channels are curved in the same direction of rotation as described herein with respect to, e.g., channels 556.

Charging can be performed under a variety of rotatable platter 112 speeds and for a variety of time periods. Charging can be performed for a time period to produce a dense and even coverage of abrasive particles in surface 116. For example, charging can be performed for a time period in the range from 5 to 120 minutes. The rotational speed of the rotatable platter can be in a range from about 10 to 60 rpms to allow the abrasive particles to become fully embedded within the surface 116. The rotational speed of the processing head 132 can also be in a range from about 10 to 60 rpm.

In some embodiments, charging can be performed under constant conditions. Accordingly, rotational velocity of the charging head 132 (532), pressure, and volume of slurry dispensed can be accurately controlled.

In one embodiment, head 132 (532) is lowered relative to surface 116 so that the land areas 552 are in contact with surface 116 while having a prescribed amount of weight forcing the land areas 552 into contact with surface 116 under a prescribed amount of pressure. During charging, the head 132 (532) can rotate counter-clockwise as indicated by arrow 142, and the platen 114 and rotatable platter 112 can rotate counter-clockwise as indicated by arrow 143. A slurry containing abrasive particles such as diamond particles can be discharged onto surface 116 via one or more dispensing units such as dispensing unit 138 discussed above. As the slurry contacts the surface 116, charging rings such as rings 550 can drive the diamond particles into surface 116 so that the particles become fixed to the surface 116 so as to form an abrasive surface for lapping operations.

As head 132 (532) rotates in the direction 142 (542) around center 553, charging rings 550 also rotate about center 553 so that abrasive slurry can flow through the channel opening 555 from a position outside the charging member outer perimeter 554 to a position inside the charging member outer perimeter 554, as indicated by arrow 557, when the land areas 552 are in contact with the major surface 116 of the lapping plate platen 114. This way, abrasive slurry can be recirculated from outside the outer perimeter 554 of a charging ring 550 inward, especially from the outer perimeter 151 of the underlying lapping plate platen 114, toward a relatively inward position of the charging ring and on lapping plate platen 114. Advantageously, relatively less abrasive slurry can go unused during a charging protocol, thereby resulting in a relatively lower amount of charging slurry dispensed. Lowering the amount of charging slurry dispensed during a charging protocol can result in significant cost savings. Also, charging rings 550 can improve the distribution of charging slurry at the interface between a given land areas 552 and the lapping plate platen 114 during the charging process, thereby increasing the density of abrasive particles that are charged into the underlying lapping plate platen 114. Increasing the density of abrasive particles can facilitate lapping more row bars with a given lapping plate platen, resulting in less down time for changing lapping plate platens and increased capacity for a given lapping plate platen.

Figure 7A:
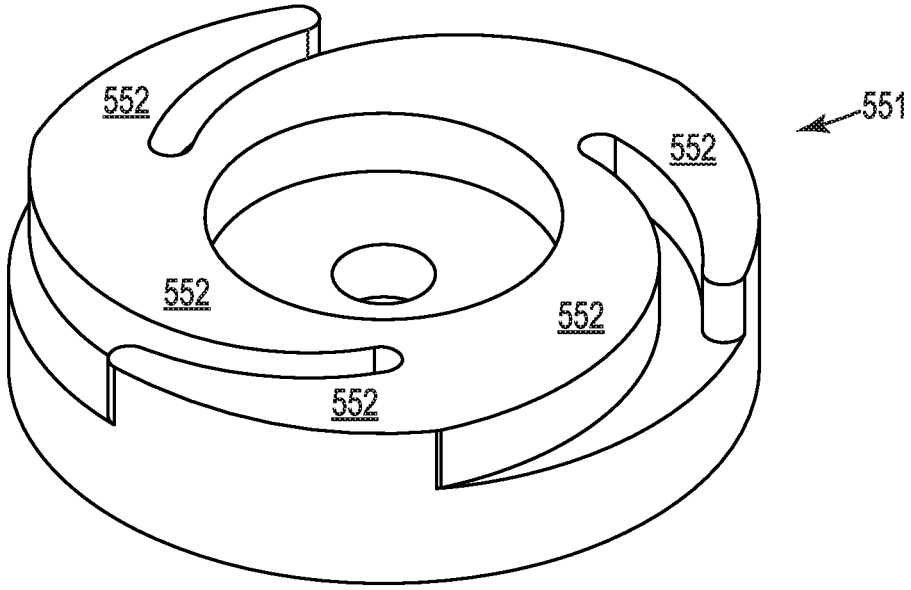
FIG. 7A is a perspective bottom view of an embodiment of a charging ring.
Figure 7B:
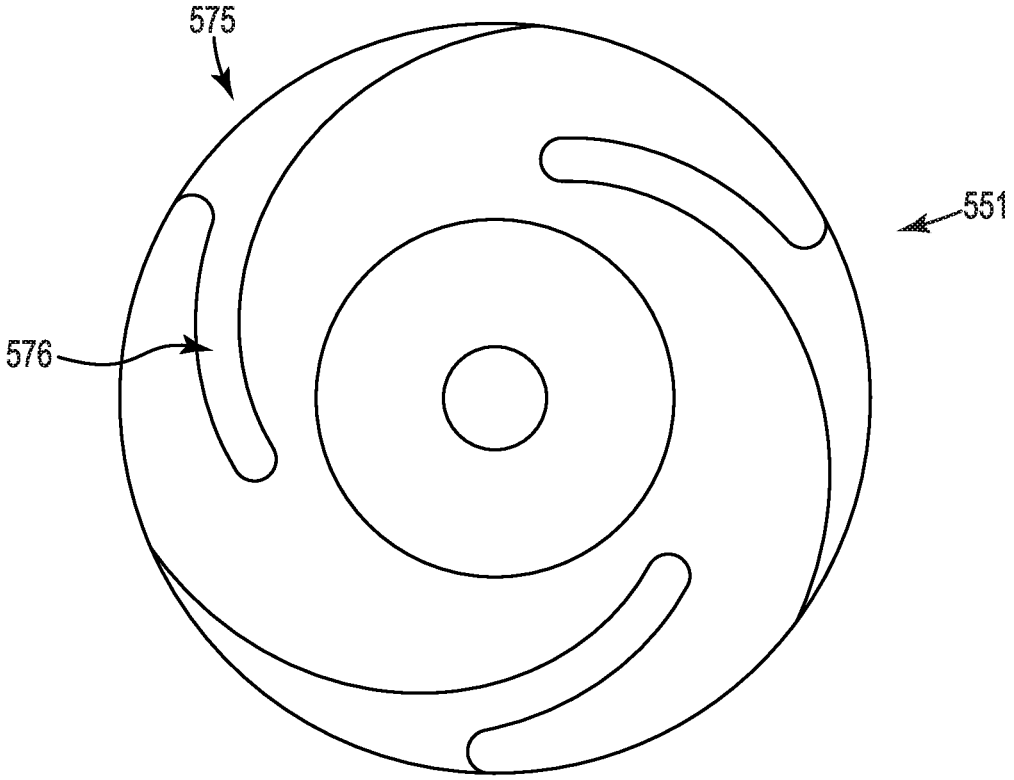
FIG. 7B is a bottom view of the charging ring shown in FIG. 7A.

FIGS. 7A and 7B illustrate an embodiment similar to charging ring 550. FIGS. 7A and 7B show charging ring 551, which is identical to charging ring 550 described herein except that charging ring 551 includes only three radial channels 576 and corresponding channel openings 575. Also, the arc shape of channels and land areas is different among ring 550 and 551 as can be seen in the figures.

Figure 10A:
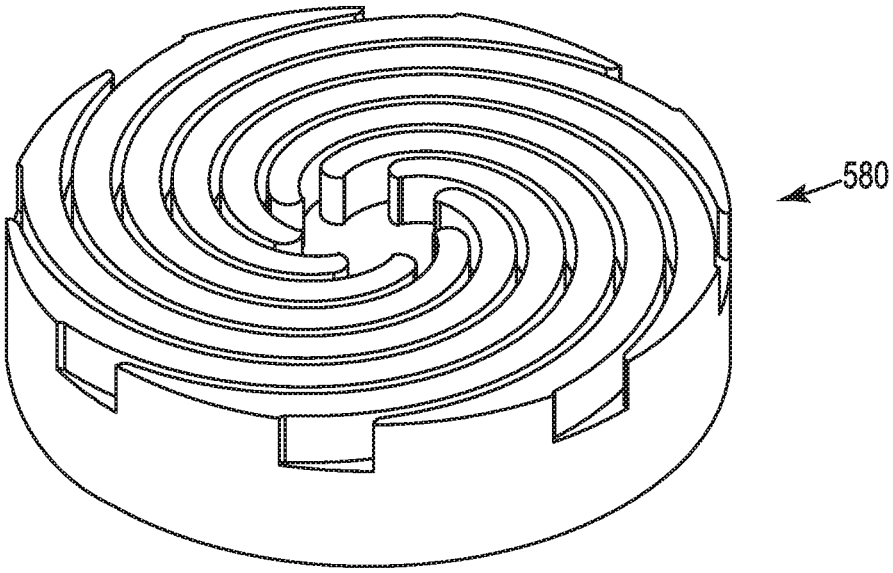
FIG. 10A is a perspective bottom view of an embodiment of a charging ring.
Figure 10B:
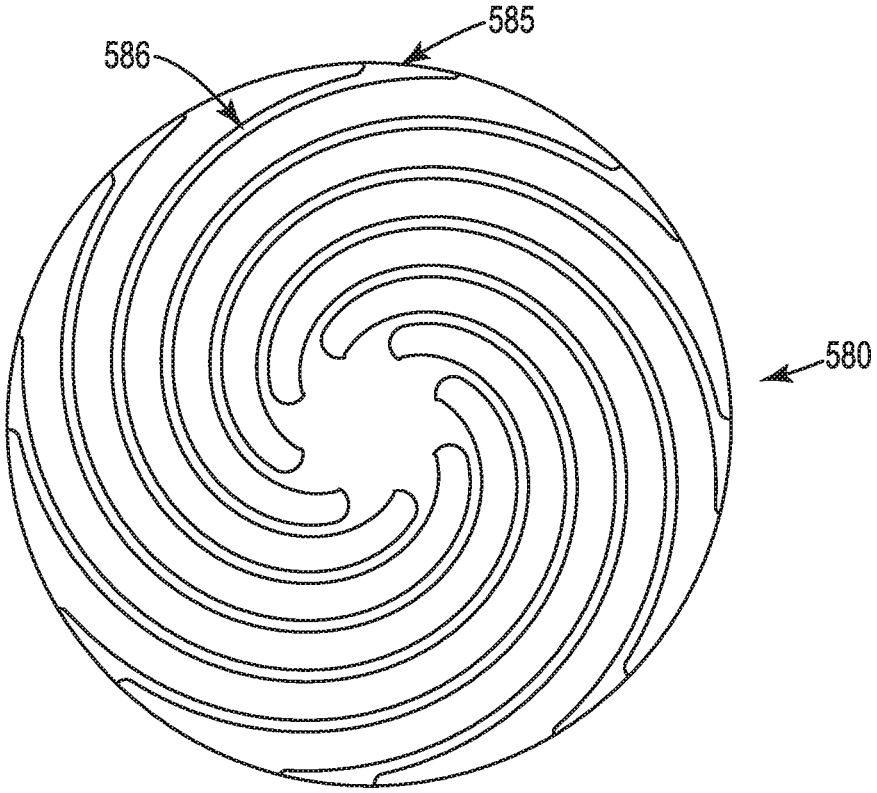
FIG. 10B is a bottom view of the charging ring shown in FIG. 10A.

FIGS. 10A and 10B illustrate an embodiment similar to charging ring 550. FIGS. 10A and 10B show charging ring 580, which is identical to charging ring 550 described herein except that charging ring 580 includes eight radial channels 586 and corresponding channel openings 585. Also, the arc shape of channels and land areas is different among ring 550 and 580 as can be seen in the figures.

Another embodiment is illustrated in FIGS. 6A, 6B, 6C, and 6D. Processing head 632 is substantially identical to processing head 132 and 532, described above, except for charging rings 650. As shown, three charging members in the form of charging rings 650 are mounted onto processing head 632. Charging rings 650 can be used to force (embed) abrasive particles into the major surface of the lapping plate platen while the land areas of the charging ring are in contact with the major surface of the lapping plate platen.

As shown, processing head 632 includes three charging members 650 attached to the head 632. The charging members 650 can be coupled to the head 632 by any suitable fastening technique (e.g., threaded bolts, adhesive, combinations of these, and the like). Also, charging members can be rigidly and/or resiliently coupled to a processing head.

The number of channel openings and channels in a given charging member can be selected as desired. In some embodiments, the number of channel openings in a charging member can be from 1 to 10, from 1 to 10, or even from 3 to 8. As shown, each charging member 650 has six channel openings 655. Each channel opening 655 and corresponding channel 656 (also called groove) defines two land areas 652 on each side of the channel 656. A processing head mechanism such as 130 can be configured to move the processing head 632 in at least the z-axis direction to contact the major surface 116 of the lapping plate platen 114 with the land areas under pressure to charge abrasive particles into the surface 116 of the lapping plate platen 114. The processing head mechanism 130 can also be configured to rotate the processing head 632 about its central axis 653 in the z-axis direction while the land areas 652 of each charging member 650 are in contact with the major surface 116 of the lapping plate platen 114 under pressure to charge abrasive particles into the surface 116 of the lapping plate platen 114.

As shown, each channel opening 655 is located proximal to an outer perimeter 654 of the charging ring 650 so that each channel opening 655 can permit abrasive slurry to flow through the channel opening 655 from a position outside the charging member outer perimeter 654 to a position inside the charging member outer perimeter 654, as indicated by arrow 657, when the land areas 652 are in contact with the major surface 116 of the lapping plate platen 114. As the slurry contacts a channel sidewall while the charging ring 650 rotates around center 653 as processing head 632 rotates, the slurry tends to flow further toward the center 633 of the charging ring 650.

Each charging ring 650 can be made out of the same materials discussed above with respect to charging ring 550.

While three charging rings 650 are shown mounted to processing head 632, any number of charging rings 650 can be used as desired. For example, one or more, three or more, or even six or more charging rings 650 could be included in a single processing head 632.

While circular shaped charging rings 650 are shown, any desired shape can be used. Examples of other shapes include elliptical shapes, polygonal shapes, and the like.

The diameter 658 of each charging ring 650 can be selected as desired. In some embodiments, a charging ring can have a diameter 558 in the range from 0.5 to 4 inches, or from 1 to 3 inches.

The thickness 659 of each charging ring 650 can be selected as desired. In some embodiments, a charging ring 650 can have a thickness 659 in the range from 1/16 to 4 inches, or from 1/8 to 2 inches.

As shown, channels 656 are formed in an annular ridge 669 that extends around the outer perimeter 654 of charging ring 650. Each channel 656 includes two sidewalls 660 and 661 that extend from the outer perimeter 654 of the charging ring 650 toward the center 633 of the charging ring 550. Each of the sidewalls 660 and 661 of each channel 656 are rounded along the channel. Rounding the channel sidewalls can reduce the tendency of chipping during use. In some embodiments, the width 668 of land areas 652 of annular ridge 669 can be in the range from $1/16^{th}$ inches to $1\frac{5}{8}^{th}$ inches. Charging ring 650 can include a mounting hole 695 for mounting charging ring to process head 632.

The depth of the channel 656 can be selected so as to facilitate the flow of abrasive slurry through the channel opening from a position outside the charging member outer perimeter to a position inside the charging member outer perimeter when the land areas are in contact with the major surface of the lapping plate platen. The channel depth may be uniform or vary along the length of a channel. In some embodiments, the channel depth corresponds to the distance of the channel vertical sidewalls from top to bottom. For example, the channel depth of channels 656 corresponds to the distances of the vertical sidewalls 660 and 661 from top to bottom. In some embodiments, the channel depth can be in the range from 1/16 inch to 3 inches, from 1/16 to 2 inches, or even from 1/8 inch to 1.5 inches. In some embodiments, the channel sidewalls can sloped or rounded from top to bottom.

The width of the channel 656 can be selected so as to facilitate the flow of abrasive slurry through the channel opening from a position outside the charging member outer perimeter to a position inside the charging member outer perimeter when the land areas are in contact with the major surface of the lapping plate platen. The channel width may be uniform or vary along the length of a channel. In some embodiments, the channel width 665 can be in the range from 1/16 inch to 1 inch, from 1/16 to 3/4 inches, or even from 1/8 inch to 1/2 inches.

Figure 6A:
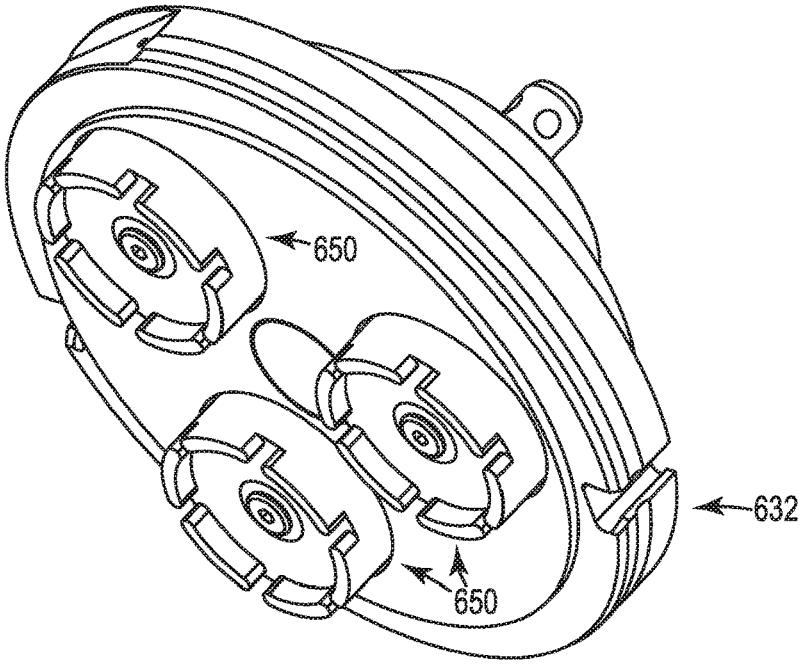
FIG. 6A perspective view of an embodiment of a processing head that includes three charging rings.
Figure 6B:
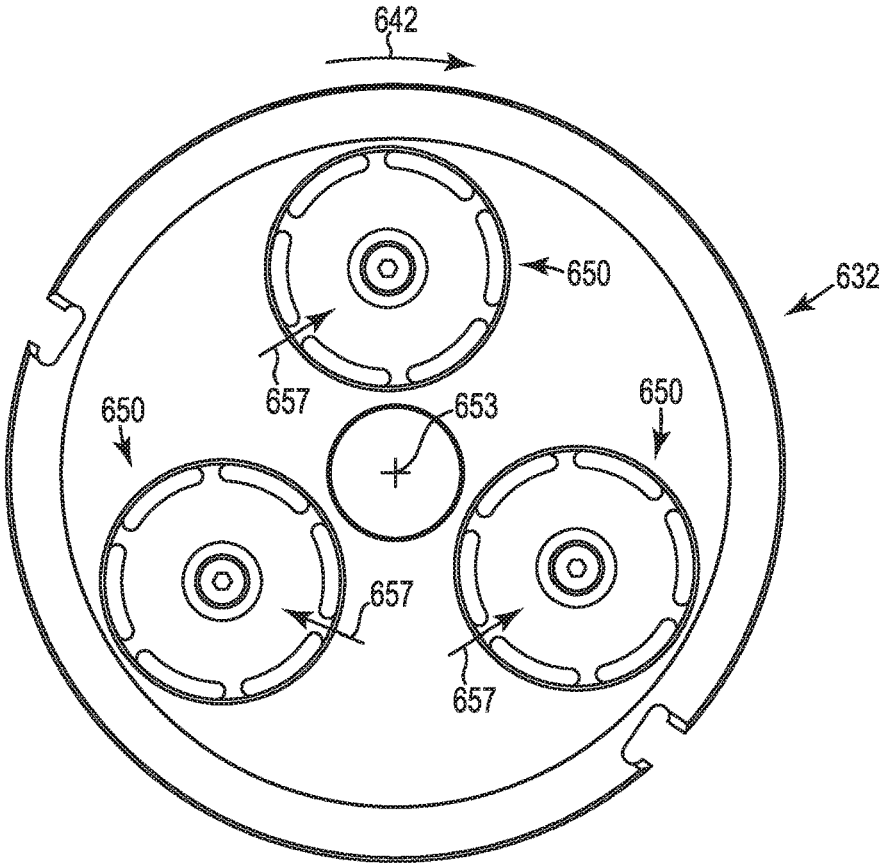
FIG. 6B is a bottom view of the processing head shown in FIG. 6A.
Figure 6C:
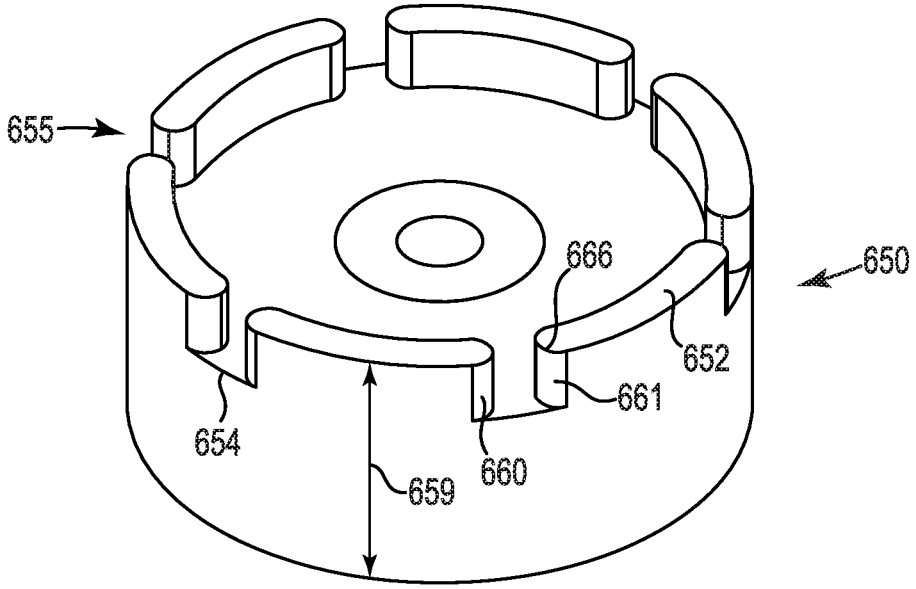
FIG. 6C is a perspective bottom view of a charging ring shown in FIG. 6A.
Figure 6D:
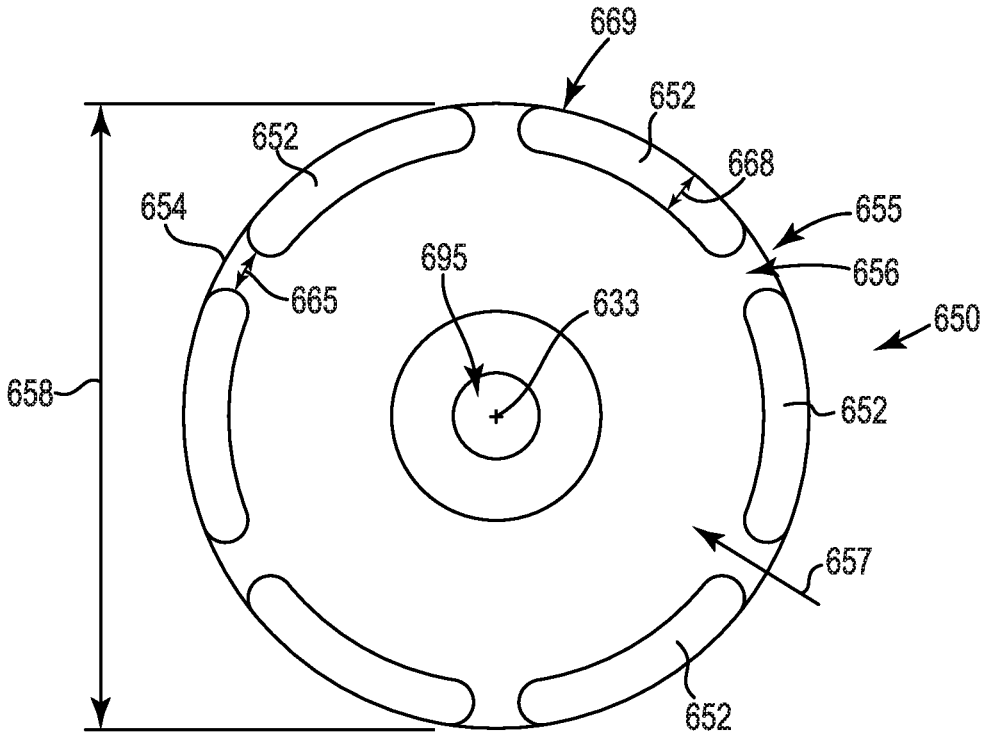
FIG. 6D is a bottom view of a charging ring shown in FIG. 6A.

The transition between land area 652 and a channel sidewall can be selected so as to facilitate the charging of abrasive particles by the land area into the underlying lapping plate platen while at the same time permitting the flow of abrasive slurry through the channel opening from a position outside the charging member outer perimeter to a position inside the charging member outer perimeter when the land areas are in contact with the major surface of the lapping plate platen. Non-limiting examples of a transition between a land area and a channel sidewall include an angled transition (e.g., right-angle, obtuse angle, or acute angle), a rounded transition, a chamfered transition, combinations of these, and the like. As shown in FIG. 6C, the transition 666 between the sidewall 661 and land area 652 is a right angle.

Charging can be performed with charging rings 650 as similarly described above with respect to charging rings 550. It is noted that processing head can be rotated as indicated by arrow 642 around the center 653 of processing head 632. However, because channel sidewalls 660 and 661 are rounded in opposite directions, the processing head 632 can be rotated either clockwise or counterclockwise and the channels 656 will still permit abrasive slurry to flow through the openings 655 in the direction of arrow 657.

Figure 9A:
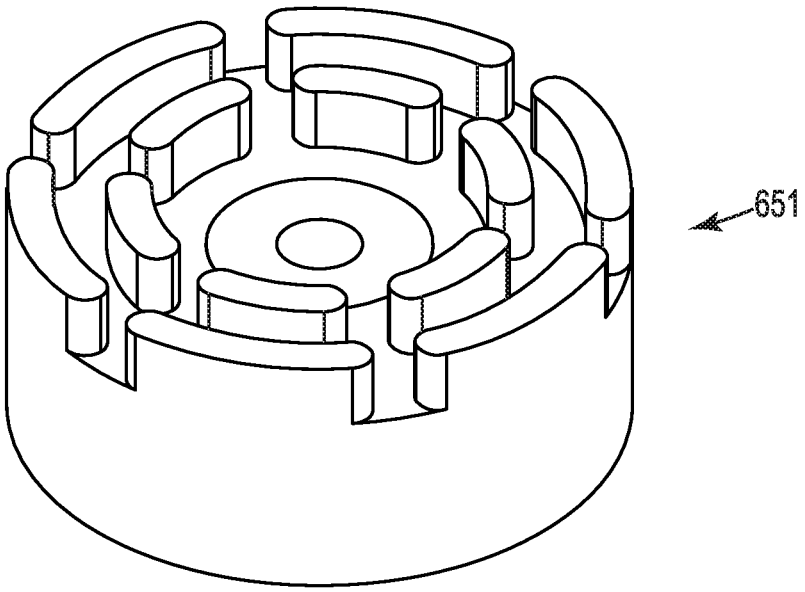
FIG. 9A is a perspective bottom view of an embodiment of a charging ring.
Figure 9B:
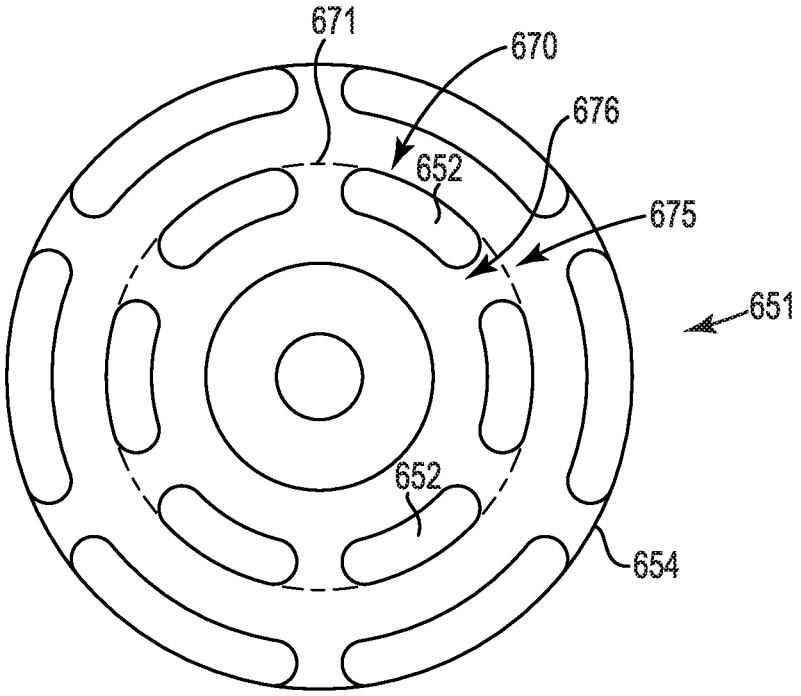
FIG. 9B is a bottom view of the charging ring shown in FIG. 9A.

FIGS. 9A and 9B illustrate an embodiment similar to charging ring 650. FIGS. 9A and 9B show charging ring 651, which is identical to charging ring 650 described herein except that charging ring 651 includes an additional annular ridge 670 extending around an inner perimeter 671 that is inside the outer perimeter 654 of charging ring 651. As shown, the additional annular ridge 671 includes channels 676. Each channel 676 includes a channel opening 675 and defines two land areas 652. Each channel opening 675 permits abrasive slurry to flow through the channel opening 675 from a position outside the inner perimeter 671 to a position inside the inner perimeter 671 when the land areas 652 of the additional annular ridge 670 are in contact with the major surface of the lapping plate platen.

Figure 8A:
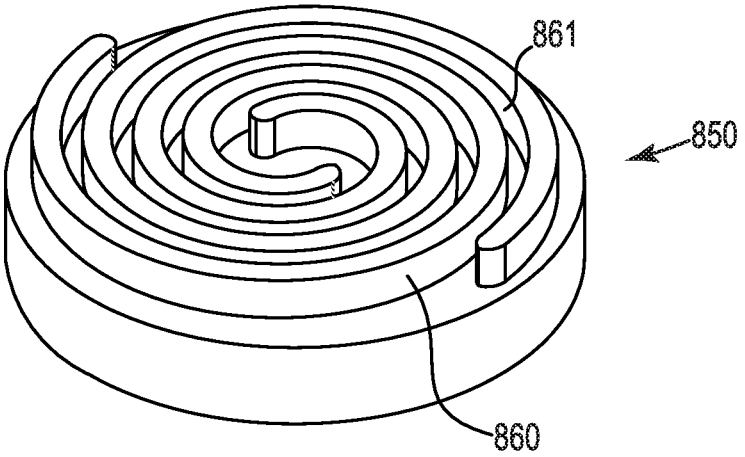
FIG. 8A is a perspective bottom view of an embodiment of a charging ring.
Figure 8B:
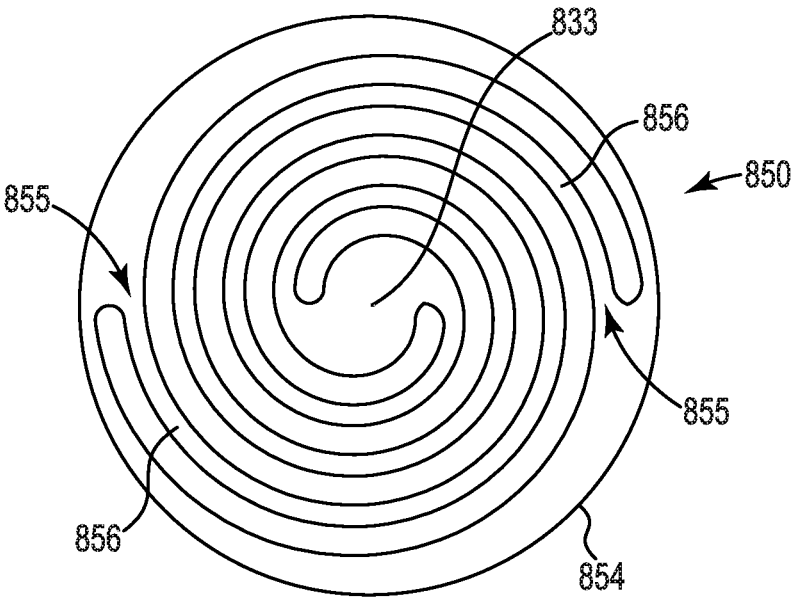
FIG. 8B is a bottom view of the charging ring shown in FIG. 8A.

FIGS. 8A and 8B illustrate yet another nonlimiting embodiment of a charging member. FIGS. 8A and 8B show charging ring 850, which is identical to charging ring 550 described herein except for the channels. Charging ring 850 include two concentric channels 856 and two corresponding channel openings 855. Each channel 856 includes two sidewalls 860 and 861 that extend from the outer perimeter 854 of the charging ring 850 around the center 833 of charging ring 850 and toward the center 833 of the charging ring 850 in a spiral manner.

What is claimed is:

1. An apparatus for processing a major surface of a lapping plate platen during the manufacture of an abrasive surface on the major surface of the lapping plate platen, wherein the apparatus comprises:

a) a rotatable platter configured to secure and physically support the lapping plate platen during processing of the major surface of the lapping plate platen;

b) at least one processing head mechanism that is rotatably and removably coupled to a processing head, wherein the processing head comprises:

i) a base;

ii) at least one charging member coupled to the base, wherein the at least one charging member has at least one channel opening that defines at least two land areas, wherein the processing head mechanism is configured to move the processing head in at least the z-axis direction to contact the major surface of the lapping plate platen with the at least two land areas under pressure to charge abrasive particles into the surface of the lapping plate platen, wherein the processing head mechanism is configured to rotate the processing head about its central axis in the z-axis direction while the at least two land areas of the at least one charging member are in contact with the major surface of the lapping plate platen under pressure to charge abrasive particles into the surface of the lapping plate platen, wherein the at least one channel opening is located proximal to an outer perimeter of the charging member, wherein the at least one channel opening permits abrasive slurry to flow through the channel opening from a position outside the charging member outer perimeter to a position inside the charging member outer perimeter when the at least two land areas are in contact with the major surface of the lapping plate platen.

2. The apparatus of claim 1, wherein the at least one channel comprises a plurality of radial channels, wherein each of the plurality of channels comprises two sidewalls that extend from the outer perimeter of the charging member toward the center of the charging member.

3. The apparatus of claim 2, wherein the two sidewalls of each channel are arc-shaped, wherein the arc is curved in the same direction that processing head mechanism is configured to rotate.

4. The apparatus of claim 1, wherein when the processing head mechanism rotates the processing head about its central axis in the z-axis direction the at least one charging member coupled to the base rotates about the central axis of the processing head.

5. The apparatus of claim 1, wherein the at least one charging member coupled to the base comprises three or more charging member coupled to the base.

6. The apparatus of claim 1, wherein the at least one charging member is made of material comprising one or more metals, one or more ceramics, one or more glasses, and combinations thereof.

7. The apparatus of claim 1, wherein the at least one charging member is made of material comprising alumina, zirconia toughened alumina (ZTA), yttria stabilized zirconia, boron nitride, aluminum nitride, aluminum silicate, magnesium oxide, and combinations thereof.

8. An apparatus for processing a major surface of a lapping plate platen during the manufacture of an abrasive surface on the major surface of the lapping plate platen, wherein the apparatus comprises:

a) a rotatable platter configured to secure and physically support the lapping plate platen during processing of the major surface of the lapping plate platen;

b) at least one processing head mechanism that is rotatably and removably coupled to a processing head, wherein the processing head comprises:

i) a base;

ii) at least one charging member coupled to the base, wherein the at least one charging member has at least one channel opening that defines at least two land areas, wherein the processing head mechanism is configured to move the processing head in at least the z-axis direction to contact the major surface of the lapping plate platen with the at least two land areas under pressure to charge abrasive particles into the surface of the lapping plate platen, wherein the processing head mechanism is configured to rotate the processing head about its central axis in the z-axis direction while the at least two land areas of the at least one charging member are in contact with the major surface of the lapping plate platen under pressure to charge abrasive particles into the surface of the lapping plate platen, wherein the at least one channel opening is located proximal to an outer perimeter of the charging member, wherein the at least one channel opening permits abrasive slurry to flow through the channel opening from a position outside the charging member outer perimeter to a position inside the charging member outer perimeter when the at least two land areas are in contact with the major surface of the lapping plate platen, and wherein the at least one channel comprises two sidewalls that extend from the outer perimeter of the charging member around the center of charging member and toward the center of the charging member in a spiral manner.

9. The apparatus of claim 8, further comprising at least one additional annular ridge extending around an inner perimeter that is inside the outer perimeter of the charging member, wherein the at least one additional annular ridge comprises at least one channel that defines at least two land areas, wherein the at least one channel opening in the additional annular ridge permits abrasive slurry to flow through the channel opening from a position outside the inner perimeter to a position inside the inner perimeter when the at least two land areas of the additional annular ridge are in contact with the major surface of the lapping plate platen.

10. The apparatus of claim 8, wherein the at least one channel comprises at least two concentric channels, wherein each channel comprises two sidewalls that extend from the outer perimeter of the charging member around the center of charging member and toward the center of the charging member in a spiral manner.

11. The apparatus of claim 8, wherein when the processing head mechanism rotates the processing head about its central axis in the z-axis direction the at least one charging member coupled to the base rotates about the central axis of the processing head.

12. The apparatus of claim 8, wherein the at least one charging member coupled to the base comprises three or more charging member coupled to the base.

13. The apparatus of claim 8 wherein the at least one charging member is made of material comprising one or more metals, one or more ceramics, one or more glasses, and combinations thereof.

14. The apparatus of claim 8, wherein the at least one charging member is made of material comprising alumina, zirconia toughened alumina (ZTA), yttria stabilized zirconia, boron nitride, aluminum nitride, aluminum silicate, magnesium oxide, and combinations thereof.

15. An apparatus for processing a major surface of a lapping plate platen during the manufacture of an abrasive surface on the major surface of the lapping plate platen, wherein the apparatus comprises:

a) a rotatable platter configured to secure and physically support the lapping plate platen during processing of the major surface of the lapping plate platen;

b) at least one processing head mechanism that is rotatably and removably coupled to a processing head, wherein the processing head comprises:

i) a base;

ii) at least one charging member coupled to the base, wherein the at least one charging member has at least one channel opening that defines at least two land areas, wherein the processing head mechanism is configured to move the processing head in at least the z-axis direction to contact the major surface of the lapping plate platen with the at least two land areas under pressure to charge abrasive particles into the surface of the lapping plate platen, wherein the processing head mechanism is configured to rotate the processing head about its central axis in the z-axis direction while the at least two land areas of the at least one charging member are in contact with the major surface of the lapping plate platen under pressure to charge abrasive particles into the surface of the lapping plate platen, wherein the at least one channel opening is located proximal to an outer perimeter of the charging member, wherein the at least one channel opening permits abrasive slurry to flow through the channel opening from a position outside the charging member outer perimeter to a position inside the charging member outer perimeter when the at least two land areas are in contact with the major surface of the lapping plate platen, wherein the at least one charging member comprises at least one annular ridge extending around the outer perimeter of the charging member, wherein the annular ridge comprises the at least one channel, wherein the at least one channel comprises two side walls that extend a length from the outer perimeter of the charging member toward the center of the charging member, and wherein the length is in range from 1/16 inches to 1 5/8 inches.

16. The apparatus of claim 15, wherein when the processing head mechanism rotates the processing head about its central axis in the z-axis direction the at least one charging member coupled to the base rotates about the central axis of the processing head.

17. The apparatus of claim 15, wherein the at least one charging member coupled to the base comprises three or more charging member coupled to the base.

18. The apparatus of claim 15, wherein the at least one charging member is made of material comprising one or more metals, one or more ceramics, one or more glasses, and combinations thereof.

19. The apparatus of claim 15, wherein the at least one charging member is made of material comprising alumina, zirconia toughened alumina (ZTA), yttria stabilized zirconia, boron nitride, aluminum nitride, aluminum silicate, magnesium oxide, and combinations thereof.

* * * * *